United States Patent [19]

Tokuda et al.

[11] Patent Number: 4,955,409

[45] Date of Patent: Sep. 11, 1990

[54] FUEL SUPPLY SYSTEM

[75] Inventors: Teruhiko Tokuda, Kosai; Koji Ishihara, Hamamatsu; Masahiko Maruyama; Manabu Wada, both of Kamimura, all of Japan

[73] Assignee: Suzuki Jidosha Kogyo Kabushiki Kaisha, Japan

[21] Appl. No.: 339,653

[22] Filed: Apr. 18, 1989

[30] Foreign Application Priority Data

Apr. 18, 1988 [JP] Japan ..... 63-95024

[51] Int. Cl.[5] ..... F02M 55/02

[52] U.S. Cl. ..... 137/561 A; 123/456

[58] Field of Search ..... 123/455, 456; 137/561 A

[56] References Cited

U.S. PATENT DOCUMENTS

| | | | |
|---|---|---|---|
| 3,789,819 | 2/1974 | Moulds | 123/456 |
| 4,369,640 | 1/1983 | Fox | 137/561 A |
| 4,570,602 | 2/1986 | Atkins et al. | 123/456 |
| 4,601,275 | 7/1986 | Weinand | 123/456 |
| 4,809,743 | 3/1989 | Sukimoto et al. | 123/456 |
| 4,836,246 | 6/1989 | Lemp | 137/561 A |

*Primary Examiner*—John Rivell
*Assistant Examiner*—L. R. Leo
*Attorney, Agent, or Firm*—Frank P. Presta

[57] ABSTRACT

There is disclosed a fuel supply system having a fuel delivery pipe for distributing fuels to injectors of cylinders. This system further includes an inner pipe fixedly inserted into the delivery pipe to constitute part of a fuel passageway, the inner pipe having a length approximate to the delivery pipe. Fuel feed and feedback pipes close to each other are connected to a proximal portion of the fuel passageway consisting of the delivery pipe and the inner pipe.

2 Claims, 3 Drawing Sheets

FUEL SUPPLY SYSTEM

BACKGROUND OF THE INVENTION

1. Field of the Invention:

The present invention relates to a fuel supply system for use with an electronic control fuel injector, the arrangement being such that an inner pipe is disposed in the interior of a fuel delivery pipe, and fuel passageways are formed for smoothing a flow of fuel.

2. Description of the Prior Art:

A fuel delivery pipe hereinafter referred to as a delivery pipe) is typically intended to distribute the fuels fed from a fuel pump (not illustrate) to injectors of cylinders respectively provided in a plurality of fuel injection passageways. In this type of delivery pipe, as illustrated in FIG. 3, the fuel is fed in from one end 1*a* of delivery pipe 1 and fed back from the other end 1*b* thereof to a fuel tank (not illustrated). It is intended to make the fuel smoothly flow through delivery pipe 1

A fuel pipe 2 connected to the fuel tank is composed of a fuel feed pipe 3 and a fuel feedback pipe 4, the ends of which are fixedly arranged in one position on the side of a vehicle 5.

One end 1*a* of delivery pipe 1 is connected to the end of fuel feed pipe 3 through a connecting hose 6 such as a high pressure fuel hose, whereby the fuel is led to delivery pipe 1. The other end 1*b* thereof is connected to the end of fuel feedback pipe 4 through a connecting hose 7 such as the high pressure fuel hose. A fuel feedback port 8 provided a the other end 1*b* of delivery pipe 1 is, however, positioned apart from the end of fuel feed pipe 3. Therefore, if port 8 is connected to the end of pipe 3, connecting hose 7 is long extended around delivery pipe 1, thus providing a lengthy route.

This arrangement causes intricacy about an engine 9A, particularly around delivery pipe 1, resulting in such a problem as to come in contact with other hoses. An additional problem is that if connecting hoses 6 and 7 involve the use of expensive high pressure fuel hoses, there will be an increase in cost corresponding to the redundant route. To cope with this problem, as depicted in FIG. 4, there is proposed an arrangement in which a fuel introduction port 11 and a fuel feedback port 12 are provided in close proximity to each other at any one of ends 10*a* of a delivery pipe 10.

Fuel introduction port 11 and fuel feedback port 12 formed in delivery pipe 10 are disposed close to each other, and similarly a fuel feed pipe 14 and a fuel fuel feedback 15 of fuel pipe 13 are positioned close to each other. Hence, even when delivery pipe 10 is connected via expensive high pressure fuel hoses 16 and 17 to fuel pipe 13, these connecting hoses may be short. As a result, the costs can be reduced.

A fuel supply system adapted to maintain a high operating performance by preventing air bubbles and fuel vapor which exist in a fuel supply pipe from intermixing with the fuel fed to a fuel injection valve is disclosed in Japanese Utility Model Laid-Open Publication No. 57770/1987, wherein the delivery pipe for the fuel injector is split into an upper casing and a lower casing to provide one united body in the vertical direction. Another fuel supply system, disclosed in Japanese Utility Model Laid-Open Publication No. 29469/1987, comprises a fuel injector valve for injecting the fuels into respective cylinders, a closed-loop fuel supply aggregative passageway connected to a fuel intake of the fuel injection valve and a closed-loop fuel feedback aggregative passageway connected to a fuel feedback port of the fuel injection valve.

Conventional delivery pipe 10 is provided, at its one end, with fuel introduction port 11 and fuel feedback port 12 disposed close to each other. The delivery pipe 10 interior is not, however, formed with a passageway for smoothing a flow of the introduced fuel. Therefore, connecting hoses 16 and 17 each leading to connecting pipe 13 are connected to fuel introduction port 11 and fuel feedback port 12 as well, as when supplying the fuel into delivery pipe 10, there arises a problem in which the fuel is hard to reach the fuel injection passageway apart form fuel introduction port 11. Where an obstacle to the fuel flow is thus caused, the fuel stagnates in delivery pipe 10. This brings about problems of causing a difference in fuel temperature and a scatter in ignition.

The delivery pipe for use with the fuel injector disclosed in Japanese Utility Model Laid-Open Publication No. 57770/1987 is intended to prevent the intermixing of air bubbles but is not adapted to obviate the foregoing technical problems inherent in the prior art. The technique disclosed in Japanese Utility Model Laid-Open Publication No. 29469/1987 is conceived as an improvement of the fuel injection valve but is incapable of smoothing the fuel flow within the delivery pipe.

SUMMARY OF THE INVENTION

It is a primary object of the present invention to provide a fuel supply system including a delivery pipe which causes no fuel stagnation and no difference in fuel temperature by forcibly flowing the fuel to a fuel passageway formed in this delivery pipe.

To this end, according to one aspect of the invention, there is provided a fuel supply system comprising a delivery pipe for distributing the fuels to respective cylinders, characterized in that an inner pipe having a length approximate to the delivery pipe is fixedly inserted therein to constitute part of a fuel passageway, and a fuel feed pipe and a fuel feedback pipe disposed close to each other are connected to a proximal portion of the fuel passageway composed of the delivery pipe and the inner pipe.

Based on this construction, when the fuel is fed from the fuel feed pipe into the inner pipe provided inwardly of the delivery pipe, the fuel flows into the delivery pipe from a portion vicinal to a fuel injection passageway at the longest distance from the connecting position of the fuel feed pipe. Subsequently, the fuel is supplied from the fuel injection passageway disposed remotest from the connection position of the fuel feed pipe provided in the delivery pipe sequentially to fuel injection passageways closer to the fuel feed pipe, and is then discharged to the fuel feedback pipe.

Even when the fuel feed pipe and the fuel feedback pipe are closely mounted on the proximal portion of the delivery pipe, the fuel flows through the delivery pipe without causing any stagnation, and the variations in temperature can also be restrained. The thus formed passageway inside the delivery pipe eliminates the necessity for leading round the fuel hoses outside the delivery pipe unlike the prior art. The pipe arrangement around the delivery pipe can be simplified, and at the same time the fuel hoses are able to steer clear of other hoses.

Besides, it is possible to reduce the lengths of expensive connecting fuel hoses suited to high pressures, thereby decreasing the costs. The fuel feed pipe can be moved to arbitrary positions, resulting in an expansion of degree of freedom in terms of design.

BRIEF DESCRIPTION OF THE DRAWINGS

Other objects and advantages of the invention will become apparent during the following discussion in conjunction with the accompanying drawings, in which.

DESCRIPTION OF THE PREFERRED EMBODIMENTS

Figure 1:
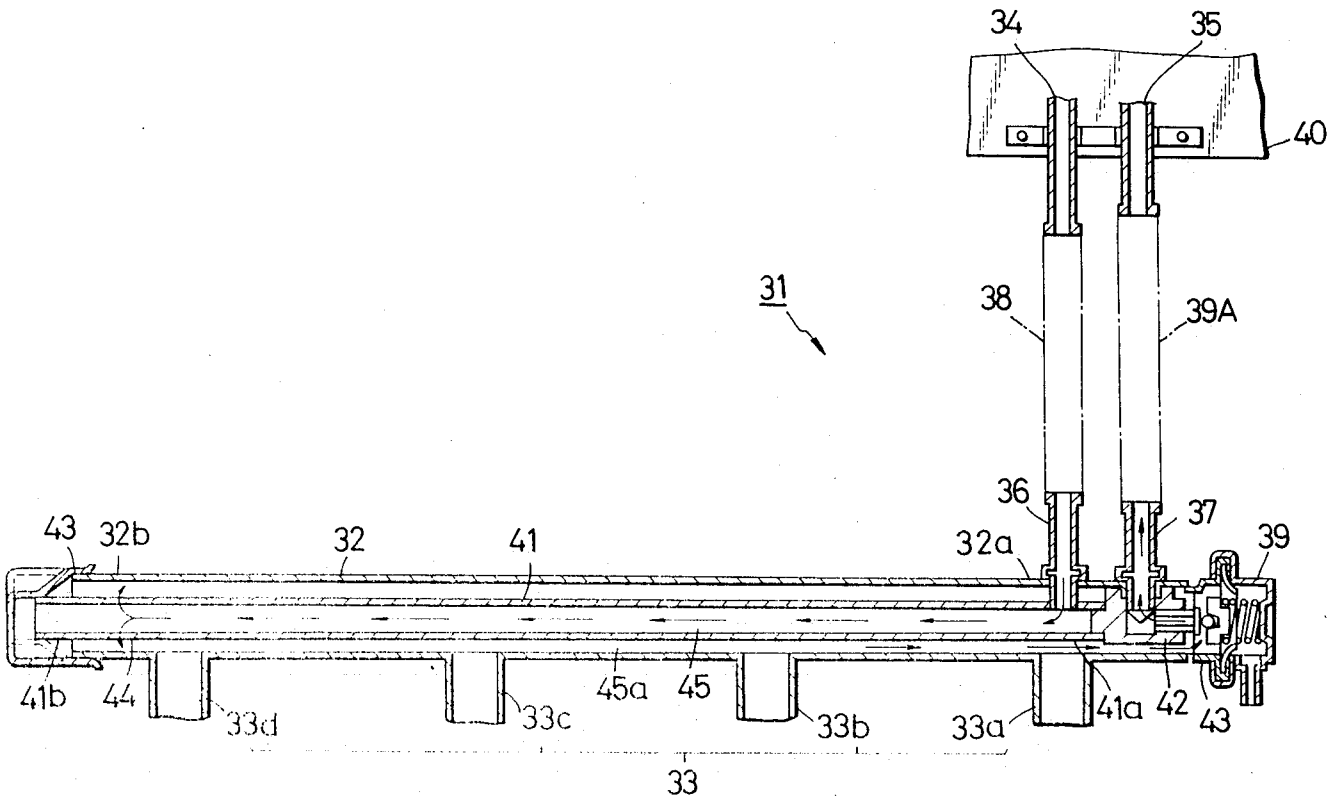
FIG. 1 is a sectional view illustrating one embodiment of the present invention.

Turning first to FIG. 1, there is shown one embodiment of the present invention. In FIG. 1, the reference numeral 31 designates a fuel supply system according to the present invention. A delivery pipe generally indicated at 32 performs a function to distribute fuels fed from a fuel pump (not illustrated) to injectors corresponding to individual cylinders, the injectors being provided in a fuel injection passageway 33. Disposed at one end 32*a* (to the right-hand in FIG. 1, i.e., at the proximal portion of a fuel passageway which will hereinafter be mentioned) of delivery pipe 32 are a fuel introduction port 36 and a fuel feedback port 37 which are disposed close to each other and connected to a fuel feed pipe 34 and a fuel feedback pipe 35. Fuel feed pipe 34 is connected to a fuel tank (not illustrated also in the following discussion). Fuel feed pipe 34 is intended to feed the fuel in this fuel tank via fuel feed pipe 34 to delivery pipe 32. Fuel feedback pipe 35 is adapted to feed back the remaining fuel which has not been injected by injectors to the fuel tank via a pressure regulator 39 and a connecting hose 39A which will be mentioned later. Fuel feed pipe 34 and fuel feedback pipe 35 disposed close to each other arc mounted on a vehicle 40.

Provided in the interior of delivery pipe 32 is an inner pipe 41 having a length approximate to delivery pipe 32, one end 41*a* of which is fixed to a connector 42 provided at one end 32*a* of delivery pipe 32. The other end 41*b* of inner pipe 41 fixed to a plug 43 secured to the other end 32*b* of delivery pipe 32.

A pipe leading from fuel introduction port 36 is connected to one end 41*a* of inner pipe 41, while in the other end 41*b* of inner pipe 41 there is formed a bore 44 through which the fuel flows into a fuel passageway 45*a* in delivery pipe 41. A fuel passageway 45 formed inwardly of inner pipe 41 communicates with fuel feedback port 37 via bore 44 of inner pipe 41 and also fuel passageway 45*a* of delivery pipe 32.

Formed in delivery pipe 32 are U-shaped fuel passageways 45 and 45*a* extending from one end 41*a* of inner pipe 41 to one end 32*a* of delivery pipe 32. The fuel flowing in delivery pipe 32 is supplied sequentially from a fuel injection passageway 33*d* disposed remotest from the connecting position of fuel introduction port 36 to a fuel injection passageway 33*a* disposed closest thereto. The numeral 39 represents a pressure regulator for stabilizing the fuel pressures at a constant level when the pressure is acting on the injectors. The stabilization of pressures involves the steps of unclosing an outlet by depressing a diaphragm 43 and feeding back the fuel to the fuel tank.

When the fuel id fed from the fuel tank via fuel feed pipe 34, connecting hose 38 and fuel introduction port 36 into delivery pipe 32 of thus constructed fuel supply system 31, the fuel passes through a fuel passageway 45 of inner pipe 41 connected to a pipe leading from fuel introduction port 36 within delivery pipe 32 and then flows from bore 44 formed at the other end 41*b* of inner pipe 41 into fuel passageway 45*a* between delivery pipe 32 and inner pipe 41. More specifically, the fuel is turned back in delivery pipe 32 and supplied from fuel injection passageway 33*d* provided remotest from the connecting position of fuel introduction port 36 sequentially to fuel injection passageways 33*c*, 33*b* and 33*a*. Next, the fuel is discharged into fuel feedback pipe through pressure regulator 39. Hence, even when fuel introduction port 36 and fuel feedback port 37 positioned close to each other are provided at one end of delivery pipe 32, there is caused no obstacle to the flow of fuel within delivery pipe 32. Therefore, the fuel does not stagnate in delivery pipe 32.

Figure 2:
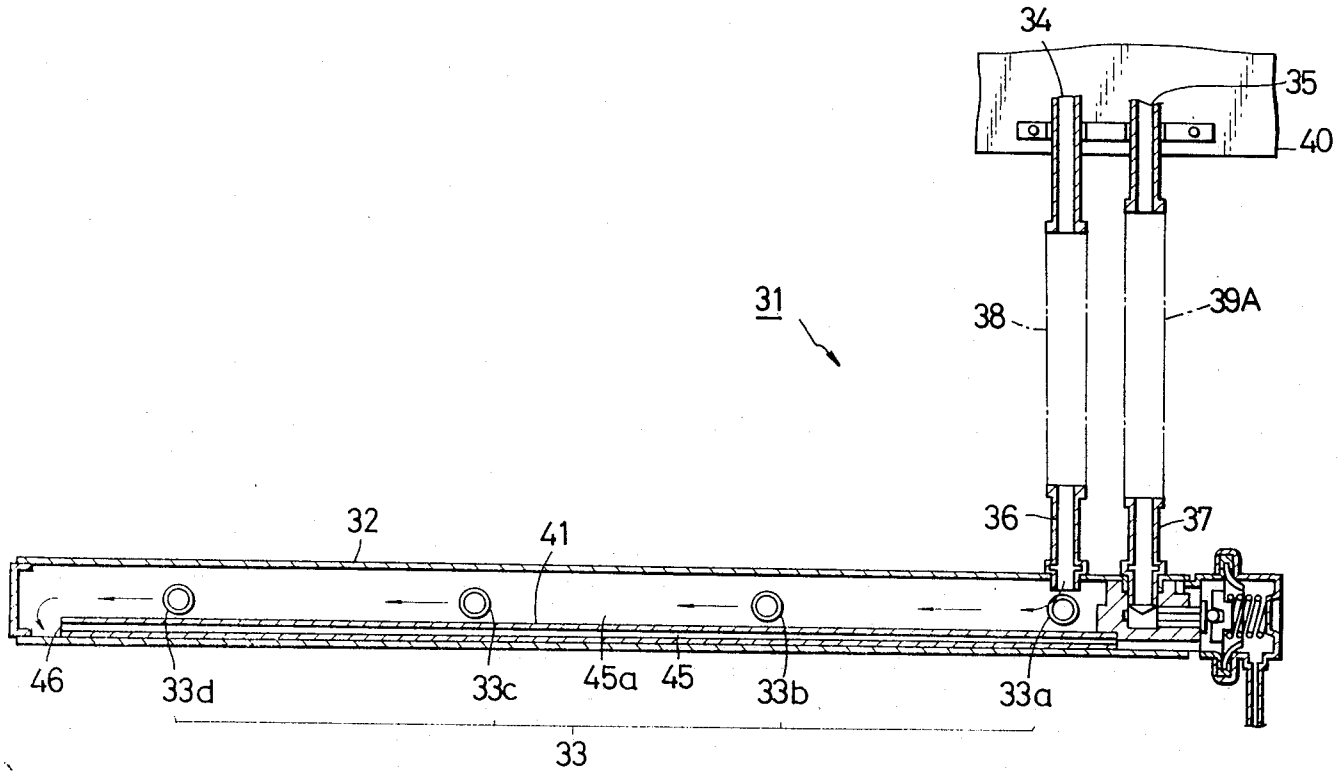
FIG. 2 is a sectional view showing another embodiment of the present invention.
Figure 3:
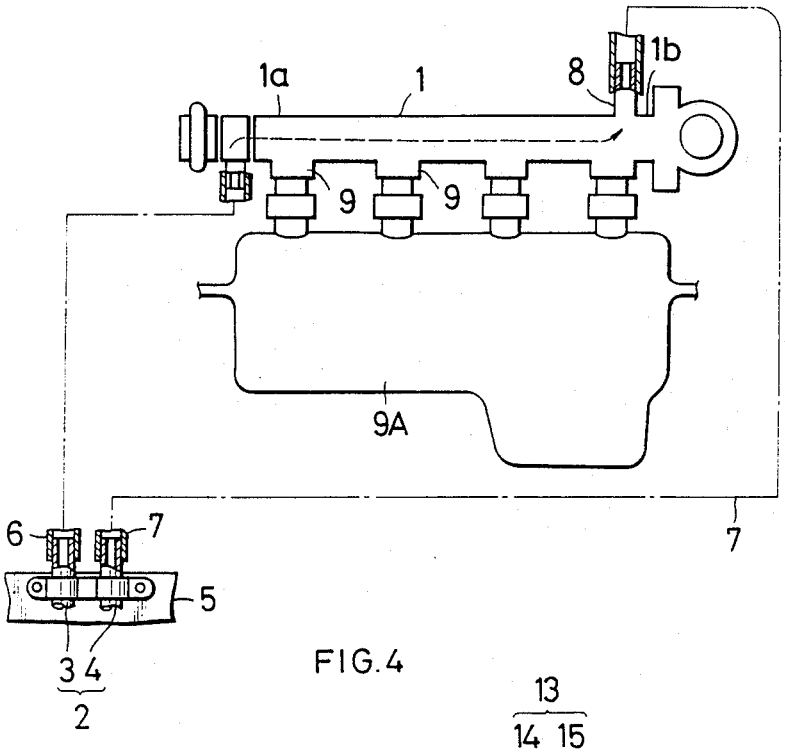
FIGS. 3 and 4 are views each schematically depicting a connecting state of a delivery pipe of a conventional fuel supply system.
Figure 4:
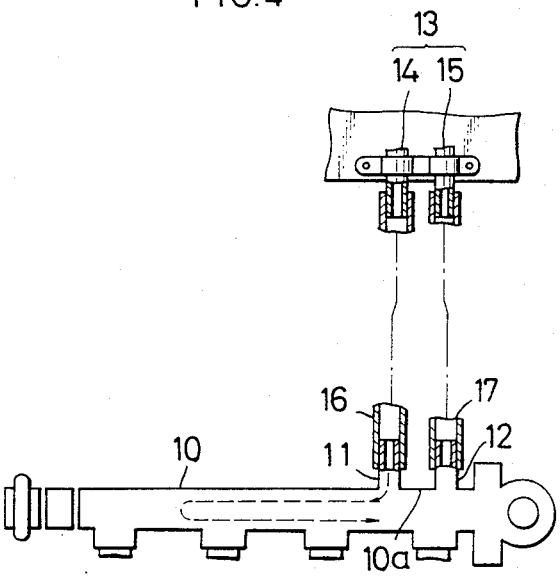

The description will next deal with another embodiment in conjunction with FIG. 2. The same components as those used in the first embodiment are marked with the like symbols, and the detailed explanation is therefore omitted herein. A characteristic arrangement of the second embodiment is that inner pipe 41 provided inwardly of delivery pipe 32 is fixedly welded to an inner wall of delivery pipe 32, the pipe leading from fuel introduction port 36 is connected directly to delivery pipe 32, and fixed inner pipe 41 is made to serve as fuel feedback passageway 45.

On fueling the fuel into thus arranged delivery pipe 32, the fuel is supplied to fuel inception passageway 33*a* provided closest to the connecting position of fuel introduction port 36 of delivery pipe 32. A fuel feedback bore 46 serves to flow the fuel into delivery pipe 32 from a portion vicinal to the fuel injection passageway disposed remotest from the position in which the fuel introduction port is provided. In the delivery pipe the fuel is fed from the remotest fuel injection passageway from the connecting position of the fuel feed pipe sequentially to the fuel injection passageways closer to the fuel feed pipe, and is then discharged into the fuel feedback pipe. Hence, even if the fuel feed pipe and the fuel feedback pipe are closely mounted on the proximal portion of the delivery pipe, there is caused no fuel stagnation in the delivery pipe.

Although the illustrative embodiments have been described in detail with reference to the accompanying drawings, it is to be understood that the present invention is not limited to those precise embodiment. Various changes or modifications may be effected therein by one skilled in the art without departing from the scope or spirit of the invention.

What is claimed is:

1. A fuel supply system comprising: a fuel delivery pipe for distributing fuels to injectors corresponding to respective cylinders, an inner pipe inserted fixedly into said fuel delivery pipe to constitute part of a fuel passageway, a fuel feed pipe connected to a proximal portion of said inner pipe, a fuel feedback pipe connected to a proximal portion of said fuel delivery pipe and disposed closely adjacent to said fuel feed pipe and to the proximal portion of the inner pipe, and at least one opening disposed on the end portion of the inner pipe opposite to the proximal portion thereof to communicate with the fuel delivery pipe, whereby the closely adjacent spacing of said fuel feed pipe and said fuel feedback pipe at the proximal portion of said inner pipe and said fuel delivery pipe minimizes obstacles to the flow of fuel within said fuel delivery pipe and shortens the connections between said fuel feed and feedback pipes and fuel pipes connected to the fuel tank.

2. A fuel supply system as set forth in claim 1, wherein said opening is at least one aperture provided on the end portion of the inner pipe opposite to the proximal portion.

* * * * *